US005484378A

United States Patent [19]

Braithwaite

[11] Patent Number: 5,484,378

[45] Date of Patent: Jan. 16, 1996

[54] SHEET FOLDING METHOD

[76] Inventor: Norman S. Braithwaite, P.O. Box 992815, Redding, Calif. 96099-2815

[21] Appl. No.: 275,288

[22] Filed: Jul. 14, 1994

[51] Int. Cl.[6] ..... B65H 45/12

[52] U.S. Cl. ..... 493/356; 493/405; 493/451; 493/955

[58] Field of Search ..... 493/167, 174, 493/405, 451, 356, 955, 959

[56] References Cited

U.S. PATENT DOCUMENTS

| | | | |
|---|---|---|---|
| 1,012,026 | 12/1911 | Stratton . | |
| 1,645,931 | 10/1927 | Ruckert et al. . | |
| 2,023,687 | 12/1935 | Klein . | |
| 2,292,403 | 8/1942 | Peters . | |
| 2,633,657 | 4/1953 | Warren, Jr. . | |
| 3,241,829 | 3/1966 | Acher | 493/451 |
| 4,637,811 | 1/1987 | Fortney . | |
| 4,721,499 | 1/1988 | Marx et al. . | |
| 4,788,109 | 11/1988 | Mage . | |
| 4,820,255 | 4/1989 | Nanami | 493/451 |
| 5,073,161 | 12/1991 | Weder et al. . | |
| 5,176,609 | 1/1993 | Weder | 493/167 |
| 5,221,248 | 6/1993 | Weder et al. . | |

FOREIGN PATENT DOCUMENTS

| | | | |
|---|---|---|---|
| 7412054 | 3/1976 | Netherlands | 493/451 |

*Primary Examiner*—Jack W. Lavinder
*Attorney, Agent, or Firm*—Thomas R. Lampe

[57] ABSTRACT

A method of folding a flat sheet of material into a decorative symmetrical object includes placing a sheet of flexible material such as paper between a male die member and a female die member and compressing the sheet. This will form crease lines in the sheet and partially fold the sheet. Completion of the folding to form the decorative symmetrical object is accomplished manually.

9 Claims, 3 Drawing Sheets

SHEET FOLDING METHOD

TECHNICAL FIELD

This invention relates to a method of folding a flat sheet of material, such as a sheet of paper, into a decorative symmetrical object.

BACKGROUND ART

It is very difficult and time consuming for an individual to fold paper to provide certain multi-sided symmetrical designs. For example, it is quite difficult to manually fold paper or the like to produce three, five, six and seven-sided symmetrical designs. Such designs, however, may be of interest for spiritual, aesthetic or entertainment purposes. Typical designs would include, stars (five and six-sided), snowflakes (six-sided), and other similar arrangements. The completed decorative symmetrical object may be cut or uncut or folded or unfolded dependent upon the nature of the decorative symmetrical object.

The present invention relates to a method which allows an individual to readily form a decorative symmetrical object. The method of the invention incorporates a step of pre-folding a substantially flat sheet of flexible material in a certain manner utilizing mechanical means and then completing the folding manually. The method utilizes a male and female die member to perform the initial pre-folding step. This has been found to greatly facilitate manual completion of the folding operation by the hobbyist or other person performing the task.

Applicant is aware of the following U.S. patents which generally disclose various approaches for forming articles constructed of sheet material, including the employment of male and female die members: U.S. Pat. No. 2,023,687, issued Dec. 10, 1935, U.S. Pat. No. 2,633,657, issued Apr. 7, 1953, U.S. Pat. No. 1,012,026, issued Dec. 19, 1911, U.S. Pat. No. 1,645,931, issued Oct. 18, 1927, U.S. Pat. No. 5,221,248, issued Jun. 22, 1993, U.S. Pat. No. 2,292,403, issued Aug. 11, 1942, U.S. Pat. No. 4,637,811, issued Jan. 20, 1987, U.S. Pat. No. 4,721,499, issued Jan. 26, 1988, U.S. Pat. No. 4,788,109, issued Nov. 29, 1988, and U.S. Pat. No. 5,073,161, issued Dec. 17, 1991.

There is, however, no showing of utilizing male and female die members as suggested herein to form preliminary folds in connection with a decorative symmetrical object which are subsequently manually manipulated to complete the folding process.

DISCLOSURE OF INVENTION

The present invention relates to a method which can inexpensively, efficiently and effectively allow a hobbyist or other person to form decorative symmetrical multi-panel objects which heretofore have been difficult to produce.

The method of the present invention is for folding a flat sheet of material into a decorative symmetrical object having a plurality of interconnected sheet panels defined by fold lines converging to a central locus, each sheet panel being angularly disposed relative to each adjacent sheet panel and defining a predetermined angle with respect thereto about a fold line.

The method includes the step of placing a substantially flat sheet of flexible material between a male die member and a female die member. The male die member has male die segments corresponding in shape and number to the shape and number of the interconnected sheet panels of a decorative object to be formed from the substantially flat sheet of flexible material. These male die segments are interconnected by male die corners converging to a central locus and corresponding to the locations of fold lines of the decorative symmetrical object.

The female die member has female die segments also corresponding in shape and number to the shape and number of interconnected sheet panels of a decorative symmetrical object to be formed from the substantially flat sheet of flexible material. These female die segments are interconnected by female die corners converging to a central locus and corresponding to the locations of the fold lines of the decorative symmetrical object.

The male die member and the female die member are brought into engagement with the sheet of flexible material at opposed sides of the sheet of flexible material.

The method also encompasses the step of pushing the sheet of flexible material into the female die member with the male die member to change the shape of the sheet of flexible material.

Relative movement between the male die member and the female die member is terminated with the segments thereof in registry and when the sheet of flexible material is compressed therebetween and crease lines are formed in the sheet of flexible material by registered male die corners and female die corners and the sheet of flexible material is partially folded about the crease lines to form panels partially folded with respect to one another.

The male die member is then withdrawn from the female die member and the partially folded sheet of flexible material is removed from the female die member. The removed partially folded sheet of flexible material is manually manipulated to compress adjacent panels along the crease lines to complete the folding of the sheet of material along the crease lines and form the decorative symmetrical object.

Other features, advantages, and objects of the present invention will become apparent with reference to the following description and accompanying drawings.

BEST MODE FOR CARRYING OUT THE INVENTION

The drawings illustrate a male die member 10 and a female die member 12 which are utilized when carrying out the teachings of the present invention. The die members may be formed of any suitable material such as plastic. Female die member 12 is shown as including a base member 14 which provides a support therefor on a table or other surface.

Figure 1:
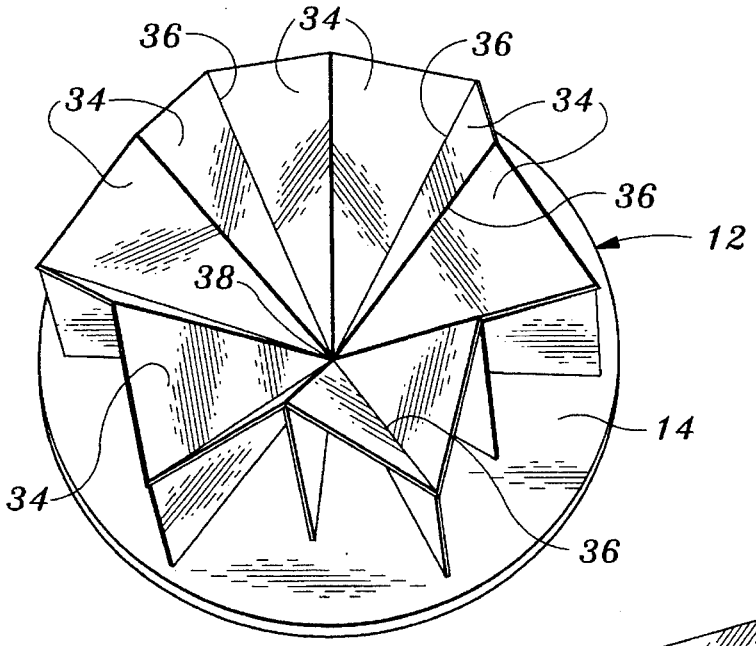
FIG. 1 is a top, perspective view of a female die member utilized when practicing the teachings of the present invention.
Figure 2:
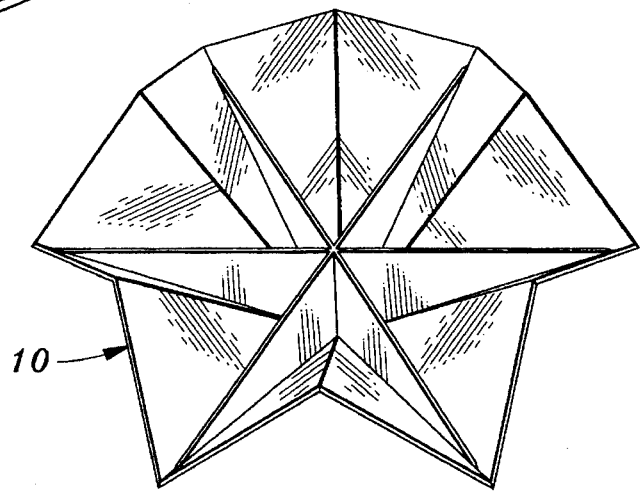
FIG. 2 is a view similar to FIG. 1 but illustrating a male die member.
Figure 3:
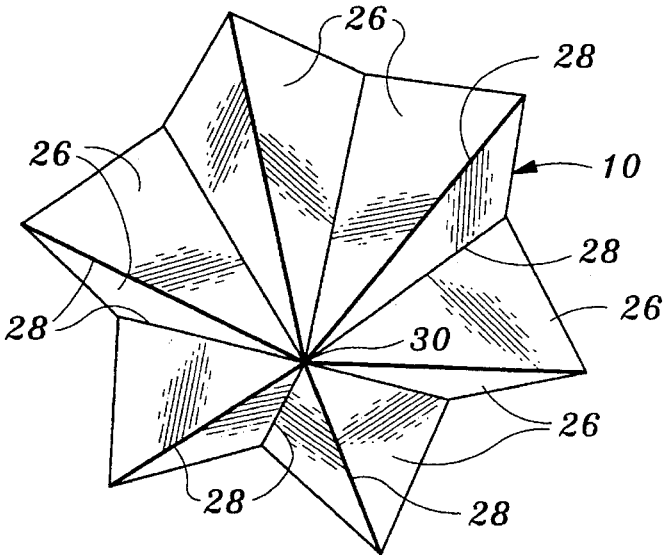
FIG. 3 is a bottom perspective view of the male die member.
Figure 4:
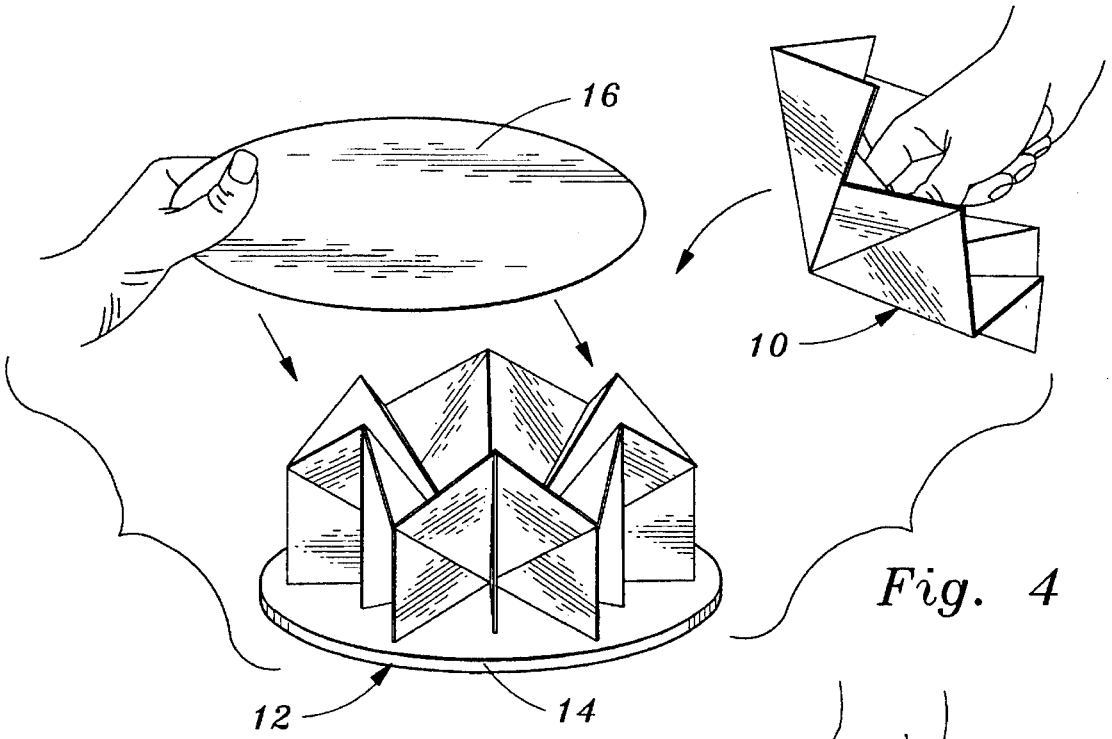
FIG. 4 is a perspective view illustrating a sheet of paper being placed between the male and female die members.
Figure 7:
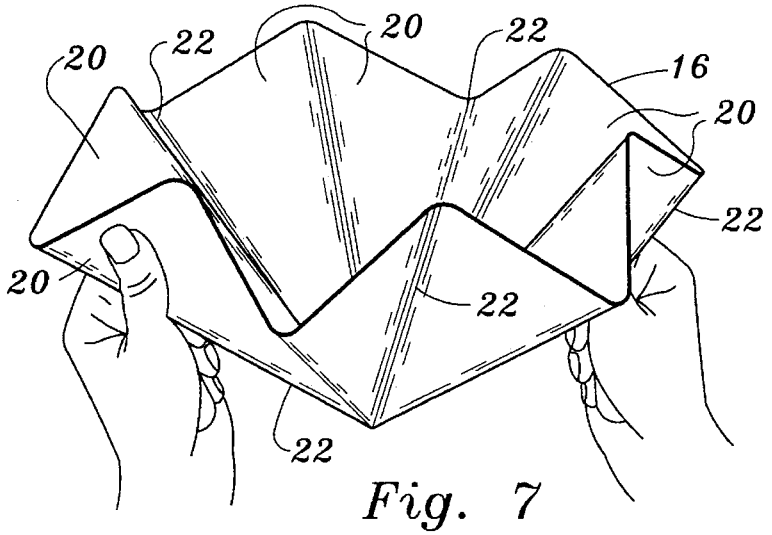
FIG. 7 illustrates the sheet of paper having been removed from the dies in partially folded condition with manual manipulation thereof carrying out the final fold operation.
Figure 8:
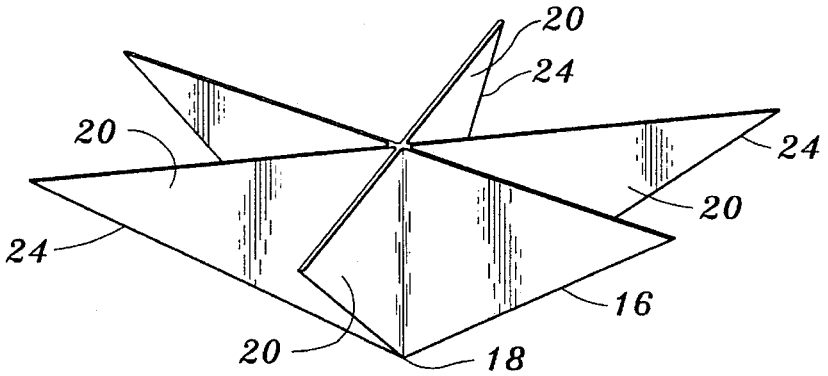
FIG. 8 illustrates a decorative symmetrical object after folding has been completed.

Die members 10, 12 are utilized to pre-fold or pre-configure a sheet of flexible material such as paper sheet 16 which will ultimately be changed from the flat planar configuration shown in FIG. 4 to the completely folded form shown in FIG. 8 which is a decorative symmetrical object. Before assuming the shape shown in FIG. 8, the paper sheet has an intermediate configuration or condition which is illustrated in FIG. 7 wherein the sheet is partially folded or configured and which will be subsequently manually manipulated as shown in FIG. 7 to form the configuration of FIG. 8.

In both the configurations of FIG. 7 and FIG. 8 the sheet has a plurality of sheet panels 20 which are generally of triangular-shaped configuration. In FIG. 7 the sheet panels 20 are separated by crease lines 22. By bringing two adjacent sheet panels together by manual manipulation as shown in FIG. 7, and running the crease lines between the thumb and forefinger, the crease lines become fold lines 24 converging to a central locus 18.

Male die member 10 has male die segments in the form of continuous panels 26 corresponding in shape and number to the shape and number of the sheet panels 20 of the folded decorative symmetrical object shown in FIG. 8. These male die panels are interconnected by male die corners 28 which converge to a central locus 30. In other words, the shape of the bottom of male die member 10 generally corresponds to the shape of the sheet material in FIG. 7.

Female die member 12 has female die segments in the form of continuous panels 34 which correspond in shape and number to the shape and number of interconnected sheet panels 20. Female die corners 36 are between the female die panels and converge to a central locus 38. It will be appreciated that the male and female die member corners correspond to placement of the crease lines 22 in the paper sheet. It is also to be understood that the particular shapes of the female die member and the male die member will depend upon the particular shape of the decorative symmetrical object one wishes to form when practicing the present invention.

Figure 5:
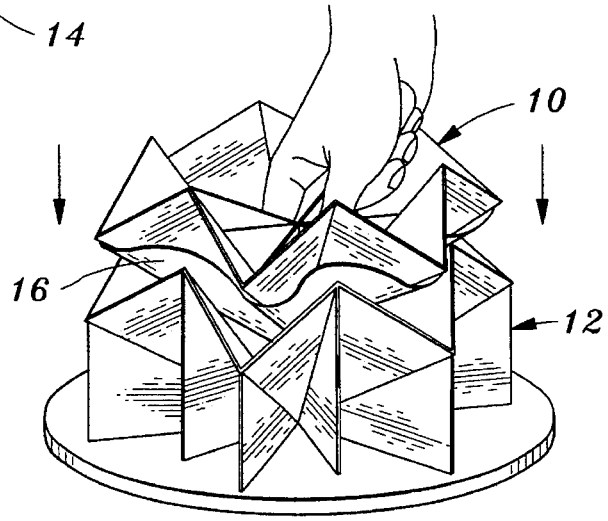
FIG. 5 shows the male die member being utilized to force the sheet of paper into the female die member.

In FIG. 4 the flat paper sheet 16 is shown being placed over and in engagement with the female die member. Next, the operator brings the bottom of the male die member into engagement with the top surface of the paper sheet 16. A downwardly directed force is then applied to the paper sheet as shown in FIG. 5 to force the paper sheet into the interior of the female die member. Relative movement between the die members and the paper sheet are facilitated by having the paper sheet engagement surfaces of the die members of smooth construction.

Figure 6:
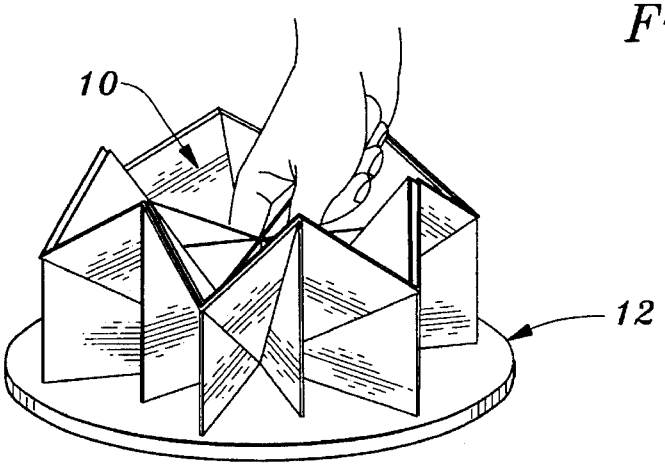
FIG. 6 illustrates the male die member completely inserted in the female die member.

The paper sheet is pushed until the male die member is fully seated in the female die member as shown in FIG. 6 with the paper sheet compressed therebetween. The registering corners of the die members will cause the formation of crease lines 22.

It is important that the paper sheet not be creased or folded except at the corner locations. To accomplish this end, the total area of each of the combined male die segments and the combined female die segments in registry and engagement with the partially folded panels of the paper sheet when the paper sheet is compressed therebetween equals the total area of the sheet panels of the decorative symmetrical object. Another way of expressing this is that the paper sheet contact surfaces of both the male and female die members would, if unfolded, lay out and extend in a flat plane if the rigid die members were in fact capable of such movement.

Figure 9:
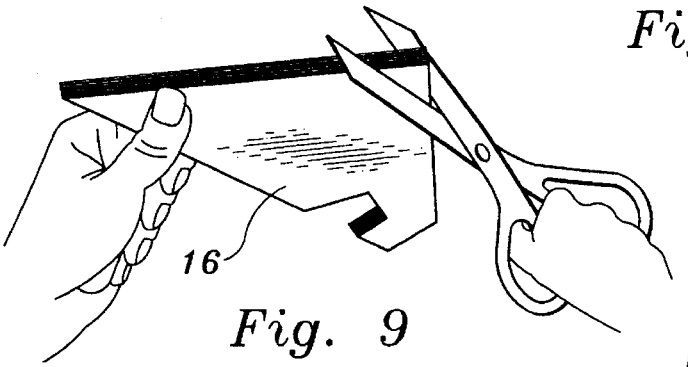
FIG. 9 illustrates a cutting step.
Figure 10:
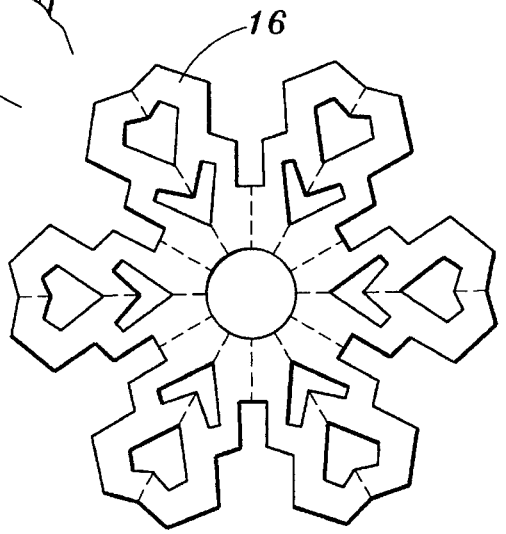
FIG. 10 illustrates an unfolded and cut decorative symmetrical object in the form of a snowflake.

The male die member is now withdrawn from the female die member and the partially folded paper sheet removed therefrom. The partially folded paper sheet will be in the condition illustrated in FIG. 7. It is then manually manipulated as previously described to form the shape of FIG. 8. If desired, the completely folded paper sheet may be cut as shown in FIG. 9 to further embellish the decoration. It may remain folded or be wholly or partially unfolded. FIG. 10 shows a cut and unfolded decorative symmetrical object in the shape of a snowflake.

I claim:

1. A method of folding a flat sheet of material into a decorative symmetrical object having a plurality of interconnected sheet panels defined by fold lines converging to a central locus, each sheet panel being angularly disposed relative to each adjacent sheet panel and defining a predetermined angle with respect thereto about a fold line, said method comprising the steps of:

placing a substantially flat sheet of flexible material between a male die member and a female die member, said male die member having male die segments corresponding in shape and number to the shape and number of interconnected sheet panels of a decorative symmetrical object to be formed from said substantially flat sheet of flexible material interconnected by male die corners converging to a central locus and corresponding to the locations of the fold lines of the decorative symmetrical object, and said female die member having female die segments also corresponding in shape and number to the shape and number of interconnected sheet panels of a decorative symmetrical object to be formed from said substantially flat sheet of flexible material interconnected by female die corners converging to a central locus and corresponding to the locations of the fold lines of the decorative symmetrical object;

bringing said male die member and said female die member into engagement with said sheet of flexible material at opposed sides of said sheet of flexible material;

pushing said sheet of flexible material into said female die member with said male die member to change the shape of said sheet of flexible material;

terminating relative movement between said male die member and said female die member with the segments thereof in registry and when said sheet of flexible material is compressed therebetween and crease lines are formed in the sheet of flexible material by registered male die corners and female die corners and when said sheet of flexible material is partially folded about said crease lines to form panels partially folded with respect to one another;

withdrawing the male die member from the female die member;

removing the partially folded sheet of flexible material from said female die member; and manually manipulating the removed partially folded sheet of flexible material to compress adjacent panels along said crease lines to complete the folding of said sheet of flexible material along said crease lines and form said decorative symmetrical object.

2. The method according to claim 1 wherein the total area of each of the combined male die segments and the combined female die segments in registry and engagement with said partially folded panels when the sheet of flexible material is compressed therebetween equals the total area of the sheet panels of the decorative symmetrical object.

3. The method according to claim 1 wherein said sheet of flexible material freely slides relative to the female die member during said pushing step.

4. The method according to claim 1 wherein at least some of said male die segments and said female die segments are continuous panels.

5. The method according to claim 4 wherein said continuous panels are flat over at least a portion thereof.

6. The method according to claim 1 wherein said flat sheet of material is paper.

7. The method according to claim 1 including the additional step of cutting the decorative symmetrical object after completing the folding thereof.

8. The method according to claim 7 including the step of unfolding the decorative symmetrical object after said cutting step.

9. The method according to claim 1 wherein all of the male die segments and all of the female die segments are continuous and flat.

* * * * *